US008087292B2

(12) United States Patent
Voelker

(10) Patent No.: US 8,087,292 B2
(45) Date of Patent: Jan. 3, 2012

(54) METHOD OF MISCIBLE INJECTION TESTING OF OIL WELLS AND SYSTEM THEREOF

(75) Inventor: Joe Voelker, Bangkok (TH)

(73) Assignee: Chevron U.S.A. Inc., San Ramon, CA (US)

( * ) Notice: Subject to any disclaimer, the term of this patent is extended or adjusted under 35 U.S.C. 154(b) by 888 days.

(21) Appl. No.: 12/112,644

(22) Filed: Apr. 30, 2008

(65) Prior Publication Data

US 2009/0272528 A1 Nov. 5, 2009

(51) Int. Cl.
*E21B 47/10* (2006.01)

(52) U.S. Cl. ..... 73/152.41

(58) Field of Classification Search ..... None
See application file for complete search history.

(56) References Cited

U.S. PATENT DOCUMENTS

| | | | | |
|---|---|---|---|---|
| 3,368,621 | A * | 2/1968 | Reisberg | 166/400 |
| 5,477,922 | A | 12/1995 | Rochon | |
| 5,501,273 | A * | 3/1996 | Puri | 166/252.5 |
| 7,272,973 | B2 | 9/2007 | Craig | |
| 2004/0186666 | A1* | 9/2004 | Manin | 702/12 |
| 2005/0279161 | A1* | 12/2005 | Chen et al. | 73/152.05 |

FOREIGN PATENT DOCUMENTS

| | | |
|---|---|---|
| EP | 0286152 | 10/1988 |
| WO | WO2005095757 | 10/2005 |
| WO | WO2007134747 | 11/2007 |

OTHER PUBLICATIONS

Weinstein, H.G., "Cold Waterflooding a Warm Reservoir," paper SPE 5083, presented at the SPE 49$_{th}$ Annual Fall Meeting, Oct. 6-9, 1974.
Bratvold et al., "Analysis of Pressure-Falloff Tests Following Cold-Water Injection, "SPEFE, Sep. 1990, pp. 293-302.
Benson et al., "Nonisothermal Effects During Injection and Falloff Tests", SPE Formation Evaluation, Feb. 1986, pp. 53-63.
M. Abbaszadeh et al., "Pressure-Transient Testing of Water-Injection Wells", SPE Reservoir Engineering, Feb. 1989, pp. 115-134.
Nanba et al., "Estimation of Water and Oil Relative Permeabilities From Pressure Transient Analysis of Water Injection Well Data", paper SPE 19829, presented at SPE 64$^{th}$ Annual Technical Conference in San Antonio, TX, Oct. 8-11, 1989, pp. 631-646.
Tang et al., "New analytical and Numerical Solutions for the Radial Convection-Dispersion Problem", SPE Reservoir Engineering, Aug. 1987, pp. 343-359.

(Continued)

*Primary Examiner* — Robert Raevis
(74) *Attorney, Agent, or Firm* — Pillsbury Winthrop Shaw Pittman LLP

(57) ABSTRACT

A method of determining reservoir permeability and geometry of a subterranean formation having a reservoir fluid including oil that has not been previously water-flooded includes isolating the subterranean formation to be tested; providing an injection fluid at a substantially constant rate from a wellhead to the formation being tested, wherein the injection fluid is miscible with the oil at the tested formation; sealing, at the top, the tested formation from further fluid injection; measuring pressure data in the tested formation including pressure injection data and pressure falloff data; and determining the reservoir permeability and geometry of the tested formation based on an analysis of the measured pressure injection data and the measured pressure falloff data using a well pressure model.

17 Claims, 15 Drawing Sheets

OTHER PUBLICATIONS

Beggs et al., "Estimating the Viscosity of Crude Oil Systems", J. of Petroleum Technology, Sep. 1975, pp. 1140-1141.
Brigham et al., "Mixing Equations in Short Laboratory Cores", Society of Petroleum Engineers Journal, vol. 257, Part II, Feb. 1974, pp. 91-99.
Mahadevan et al., "Estimation of True Dispersivity in Field Scale Permeable Media", paper SPE 75247, presented at the 2002 SPE/DOE Improved Oil Recovery Symposium, Tulsa, OK, Apr. 13-17, 2002.
Bourdet et al., "A new set of type curves simplifies well test analysis", World Oil, May 1983, pp. 95-105.
International Search Report and Written Opinion for International Application No. PCT/US2009/042025 dated Sep. 7, 2010, 9 pages.

* cited by examiner

| t (hr) | α (ft) | h (ft) | q (B/D) | Input k | Calc. k | Input s | Calc. s |
|---|---|---|---|---|---|---|---|
| 10 | 1.0 | 20 | 2000 | 100 | 102 | 20 | 21 |
| 10 | 1.0 | 20 | 200 | 100 | 97 | 20 | 19 |
| 10 | 1.0 | 20 | 20 | 100 | 92 | 20 | 18 |
| 10 | 1.0 | 20 | 2 | 100 | 94 | 20 | 18 |
| 5 | 1.0 | 20 | 2000 | 100 | 101 | 20 | 20 |
| 5 | 1.0 | 20 | 200 | 100 | 94 | 20 | 18 |

Figure 15 Summary of $k$ and $s$ predictions

METHOD OF MISCIBLE INJECTION TESTING OF OIL WELLS AND SYSTEM THEREOF

FIELD

The present invention relates generally to characterization of the productivity and geometry of oil bearing intervals in wells and more particularly to automated interpretation of short term testing without oil production to the surface.

BACKGROUND

An example of a conventional oil surface procedure for flow testing is the Drill Stem Test (DST). In this type of flow testing, the productive capacity, pressure, permeability or extent of an oil or gas reservoir is determined. DST testing is essentially a flow test, which is performed on isolated formations of interest to determine the fluid present and the rate at which they can be produced. Typical DST consists of several flow and shut in (or pressure buildup) periods, during which reservoir data is recorded.

Alternatives to the oil surface procedure for flow testing exist, but have their own inherent disadvantages or shortcomings. For example, coring and open hole wireline formation testing are known, but these methods sample a very small reservoir volume which often yields insufficient or incomplete results. Additionally, injection flow testing has been explored for water injection into water flooded oil reservoirs.

SUMMARY

In an aspect of the invention, there is provided a method of determining reservoir permeability and geometry of a subterranean formation having a reservoir fluid including oil that has not been previously water-flooded, the method comprising isolating the subterranean formation to be tested; providing an injection fluid at a substantially constant rate from a wellhead the formation being tested, wherein the injection fluid is miscible with the oil at the tested formation; sealing, at the top, the tested formation from further fluid injection; measuring pressure data in the tested formation including pressure falloff data and pressure injection data; and determining the reservoir permeability and geometry of the tested formation based on an analysis of the measured pressure injection and the measured pressure falloff data using a well pressure model.

In another aspect of the invention, there is provided a system for determining a reservoir permeability and geometry of a subterranean formation having a reservoir fluid including oil that has not previously been water-flooded, the system comprising an injector constructed and arranged to inject an injection fluid at substantially constant rate from a wellhead into the formation being tested, wherein the injection fluid is miscible with the oil at the tested formation; one or more sensors constructed and arranged to measure data in the tested layer including pressure injection data and pressure falloff data; and a machine readable medium having machine executable instructions constructed and arranged to determine the reservoir permeability and geometry of the tested formation based on an analysis of the measured pressure injection data and the measured pressure falloff data using a well pressure model stored in a memory coupled to a processor.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various Figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

FIG. 15 shows a table of k and s predictions in accordance with some embodiments of the present invention.

DETAILED DESCRIPTION

Figure 1:
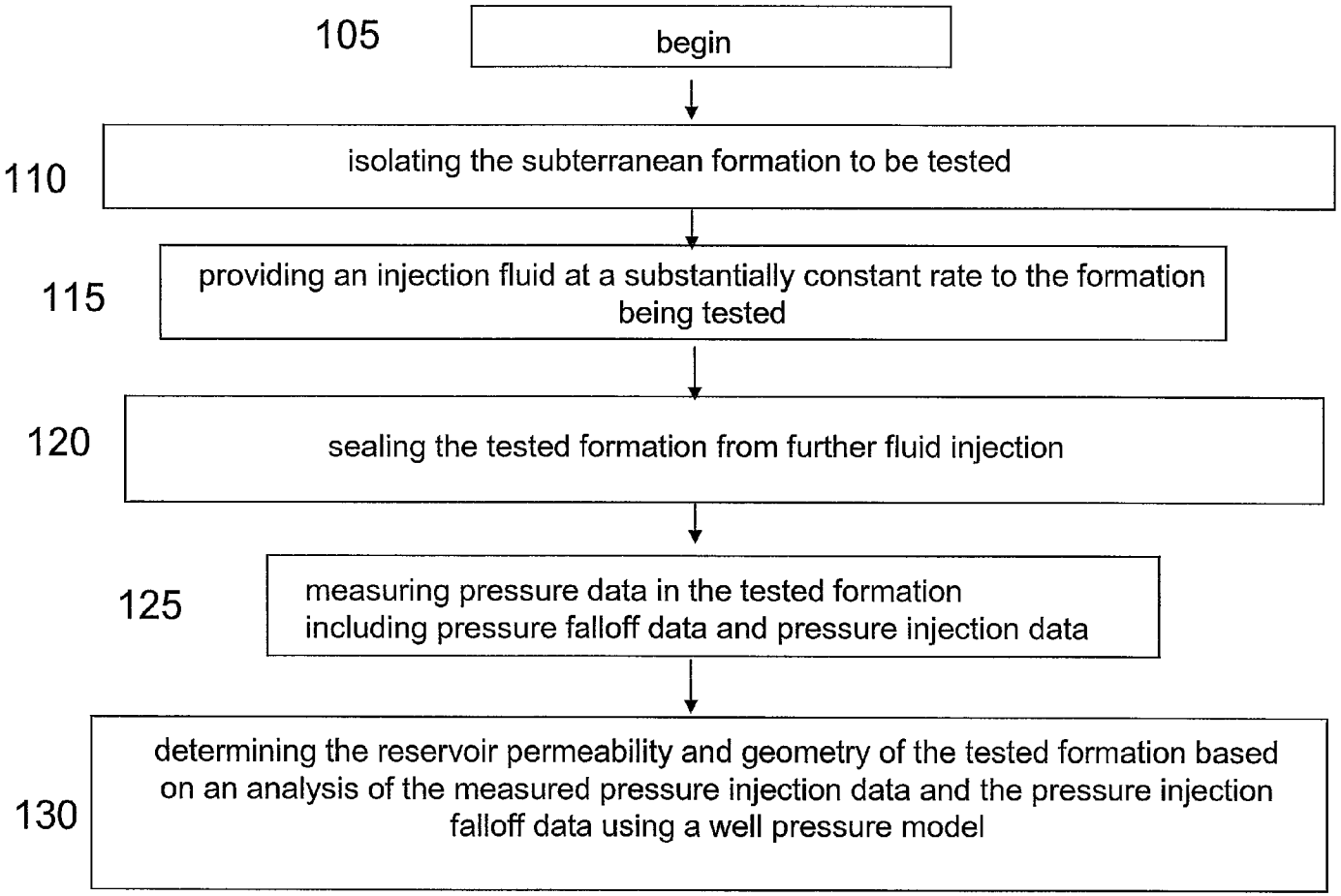
FIG. 1 generally shows a method of determining reservoir permeability and geometry of a subterranean formation in accordance with an embodiment of the invention.

Transient oil well pressure is analyzed to determine a reservoir permeability and geometry of a subterranean formation. The transient oil well pressures are provided by measuring and recording by one or more bottom hole pressure gauges down a borehole. FIG. 1 shows an example of an implementation of the reservoir permeability and geometry test method implementing certain aspects of the well pressure model. The method generally begins at step 105 for determining a reservoir permeability and geometry of a subterranean formation having a reservoir fluid including oil that has not previously been water-flooded. In some embodiments, a hollow pipe, called a drill stem, is lowered down the well from a wellhead. The wellhead is the surface termination of a wellbore. The drill stem has two expandable devices, called packers, around it. The drill stem is lowered into the wellbore or the well until a first packer is positioned just above the subterranean formation to be tested and a second packer is positioned just below the tested formation. The subterranean formation to be tested is isolated at step 110. In some embodiments, during the isolation step, the formation to be tested is isolated by expanding the first and the second packer to close the well above and below the tested formation. Isolating the formation excludes pressures from the surrounding environment, while allowing reservoir fluid to flow into the isolated subterranean formation.

An injection fluid is introduced or provided through the drill stem into the formation being tested at step 115. In some embodiments, the injection fluid is provided by an injector, which may be located at the wellhead. The injector is configured to inject the injection fluid at a substantially constant rate by being capable of continuously adjusting the discharge pressure based on the transient reservoir pressure response. The injection fluid is miscible with the oil that permeates the subterranean formation and, in an embodiment, has a higher viscosity than the oil. The higher viscosity of the injection fluid can reduce viscous fingering, which may have a detrimental effect on the wellbore pressure response during injection. The viscosity of the injection fluid can be increased by including viscosity modifiers or additives with the injection fluid that do not affect the miscibility of the injection fluid. The additives include, for example, bentonite or hectorite based organoclays and polar activators such as ethanol or triethylene glycol. In some embodiments, the injection fluid is a base oil, such as, base oil SARALINE 185V manufactured by Shell Corporation, which has a low volatility and low compressibility. The viscosity of SARALINE 185V at reservoir conditions is approximately 0.5 cp.

In some embodiments, the injection fluid is obtained from the formation being tested prior to the reservoir testing. This injection fluid, called a bottom hole sample, is preceded by a low rate influx of sufficient reservoir oil volume to assure minimal base oil contamination. Typically, this volume will not exceed a few barrels. Also, this sampling will not involve production of the reservoir oil at the surface.

After the injection fluid has been provided to the subterranean formation being tested, the formation is sealed or shut-in at step 120. The period of time that the formation is sealed or shut-in may vary from a few hours to a few days depending on the length of time for the pressure falloff data to show a pressure approaching the reservoir pressure. In some embodiments, the packers, located below and above the formation, are expanded to seal the formation from undesired influences, such as from pressures and fluids from surrounding formations.

Pressure falloff data is measured from the subterranean formation being tested during the injection period and during the subsequent shut-in period at step 125. The pressure falloff data may be measured by one or more pressure sensors. In some embodiments, additional measurement may be made during the injection period and subsequent shut-in period. These additional measurements, which may be made by one or more additional sensors, include measuring an injection pressure, a bottom hole temperature, a surface fluid injection rate, and a surface tubing pressure. In some embodiments, the sensors are constructed and arranged for measuring electrical characteristics of the wellbore material and surround formations, this is for illustrative purposes only and a wide variety of sensors may be employed in various embodiments of the present invention. In particular, it is envisioned that measurements of resistivity, ultrasound or other sonic waves, complex electrical impedance, video imaging and/or spectrometry may be employed. Consistent with this, the sensors may be selected as appropriate for the measurement to be made, and may include, by way of non-limiting example, electrical sources and detectors, radiation sources and detectors, and acoustic transducers. As will be appreciated, it may be useful to include multiple types of sensors on a single probe and various combinations may be usefully employed in this manner.

The data collected during the injection period and subsequent shut-in period is analyzed using a well pressure model of the present invention to determine the permeability and geometry of the tested formation to the reservoir fluid at step 130.

Figure 2:
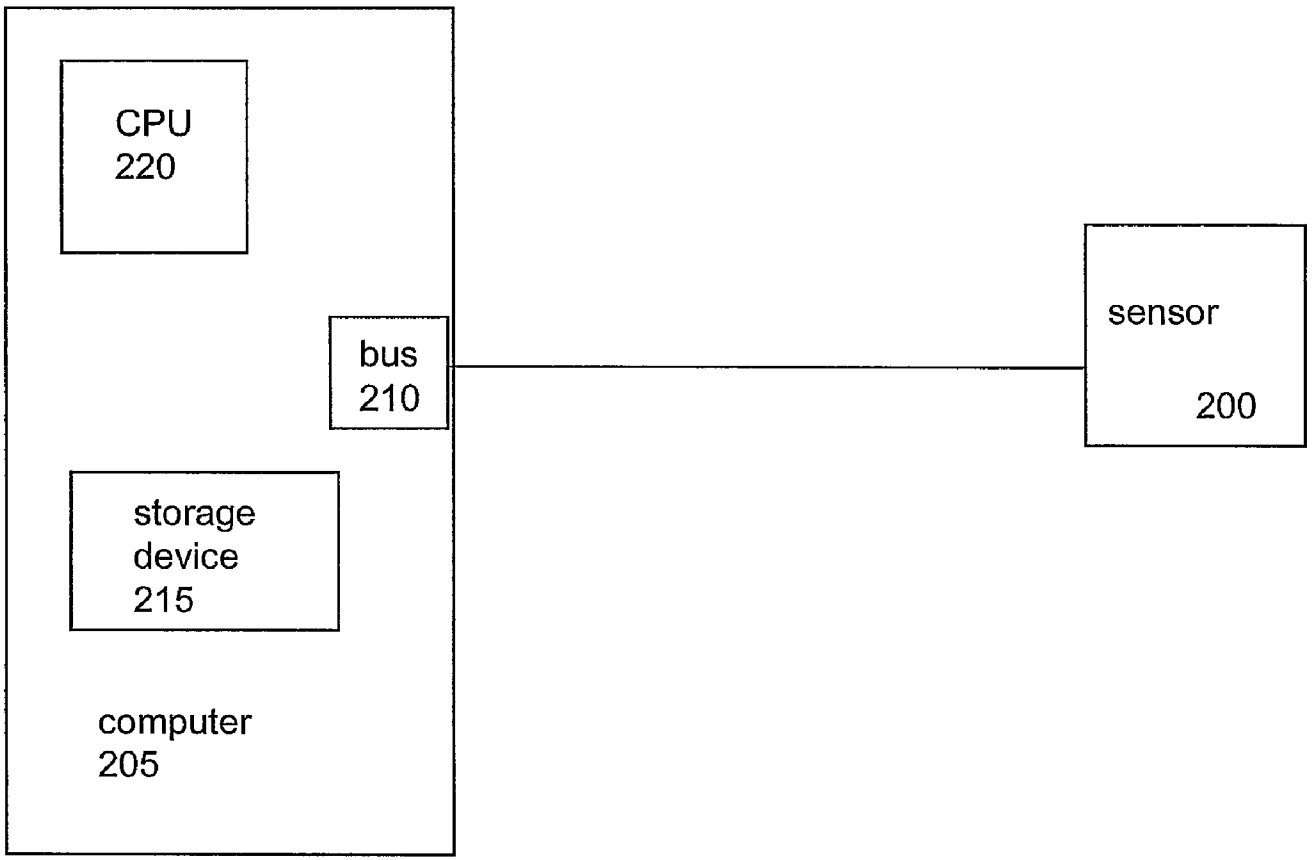
FIG. 2 is a schematic illustration of a sensor in communication with a computer in accordance with an embodiment of the invention

As shown in FIG. 2, the data collected by the sensors 200 are generally stored in a local memory device as in memorized logging-while-drilling tools or relayed via a wire, though the connection may be made wireless, to a computer 205 that may be, for example, located at a drilling facility where the data may be received via a bus 210 of the computer 205, which may be of any suitable type, and stored, for example, on a computer readable storage device 215 such as a hard disk, optical disk, flash memory, temporary RAM storage or other media for processing with a processor 220 of the computer 205.

Consistent with an aspect of the present invention, a radial model that estimates the well pressure response under constant rate miscible injection is developed. The model indicates that the variation of viscosity with time and radius, due to the mixing of injection and reservoir oils, having different viscosities due to composition and temperature differences, governs the well pressure response in part, and can cause a significant early deviation to the response associated with a single-viscosity system. However, the practical duration of this effect is short, and so the deviation does not adversely affect the estimation of reservoir parameters from well pressure data.

Let the fluid system be composed of one flowing liquid phase, oil, comprised of two miscible components, injection oil and reservoir oil, and one immiscible, immobile liquid phase, water. The governing radial mass and energy balance equations are:

$$\frac{\partial}{\partial t}[\phi(S_w\rho_w\omega_{jw} + S_o\rho_o\omega_j) + (1-\phi)\rho_R\omega_{jR}] + \frac{1}{r}\frac{\partial}{\partial r}\left[r\left(\rho_o u_o\omega_j - \phi S_o\rho_o D\frac{\partial\omega_j}{\partial r}\right)\right] = 0 \quad j = i, r. \tag{1}$$

$$\frac{\partial}{\partial t}[\phi(S_w\rho_w U_w + S_o\rho_o U_o) + (1-\phi)\rho_R U_R] + \frac{1}{r}\frac{\partial}{\partial r}\left[r\left(\rho_o u_o H_o - K\frac{\partial T}{\partial r}\right)\right] = 0. \tag{2}$$

Gravity, radiation energy flux, and fluid kinetic energy are ignored in these equations. The injection oil mass fraction of the oil phase is represented by $\omega_i$, and that for reservoir oil is $\omega_r$. The additional mass fractions $\omega_{jw}$ and $\omega_{jR}$, for j=i, r, represent those of each oil component absorbed into the water phase, and onto the rock, respectively. All elements of the equations are defined in the Nomenclature section located in the Appendix.

Assume the density of the oil phase is independent of $\omega_j$, that is, the density difference between injection oil and reservoir oil can be ignored. Then, adding the two mass balance equations (j=i,r) comprising Eq. 1, gives, $$\frac{\partial}{\partial t}[\phi(S_w\rho_w + S_o\rho_o) + (1-\phi)\rho_R] + \frac{1}{r}\frac{\partial}{\partial r}[r\rho_o u_o] = 0. \tag{3}$$

Assume the liquid phases and rock have constant compressibilities, and the oil phase compressibility is independent of $\omega_j$. Also assuming constant reservoir porosity and permeability, and ignoring second order derivative terms and capillary pressure, the following equation, similar to the diffusivity equation, results:

$$\frac{\partial p}{\partial t} - \frac{k}{\phi c_t}\frac{1}{r}\frac{\partial}{\partial r}\left(\frac{r}{\mu_o}\frac{\partial p}{\partial r}\right) = 0. \tag{4}$$

The solution of this equation at the well is the pressure model desired. The oil phase viscosity, $\mu_o$, varies with radius and time, however, so this equation is not easily solved.

A solution approach used in various studies assumes the time-dependent viscosity profile may be estimated by an analytical incompressible flow model. The viscosity profile resulting from this model is then substituted into Eq. 4, which is then solved numerically, yielding the desired well pressure response. This approach is employed herein.

The incompressible flow version of Eq. 1 is the convection-diffusion equation, assuming $\omega_{jw}$ and $\omega_{jR}$ are negligible:

$$\frac{\partial \omega_j}{\partial t} + \frac{qB_i}{2\pi rh\phi S_o}\frac{\partial \omega_j}{\partial r} - \frac{1}{r}\frac{\partial}{\partial r}\left(rD\frac{\partial \omega_j}{\partial r}\right) = 0 \quad j = i, r. \tag{5}$$

The incompressible flow version of Eq. 2, in terms of temperature, assuming constant heat capacities of liquid and rock, is, $$\frac{\partial T}{\partial t} + \beta\left[\frac{qB_i}{2\pi rh\phi}\frac{\partial T}{\partial r} - \frac{1}{r\rho_o c_{po}}\frac{\partial}{\partial r}\left(rK\frac{\partial T}{\partial r}\right)\right] = 0, \tag{6}$$

where, $$\beta = \frac{\rho_o c_{po}}{\rho_w c_{pw} S_w + \rho_o c_{po} S_o + \frac{1-\phi}{\phi}\rho_R c_{pR}}. \tag{7}$$

The interstitial velocities of the injection oil front, v and of its temperature front, $v_T$ are indicated in Eqs. 5 and 6, to be, $$v = \frac{qB_i}{2\pi rh\phi S_o}. \tag{8}$$

$$v_T = \beta\frac{qB_i}{2\pi rh\phi}. \tag{9}$$

The interstitial velocities correspond to that of the centers of two moving transition zones, that between pure injection oil, $\omega_i$=1, and pure reservoir oil, or $\omega_r$=1, and between injection temperature $T_i$ and reservoir temperature $T_r$. The diffusion coefficients in Eqs. 5 and 6, D and K, control the widths of the transition zones. The fronts are piston-like only if the diffusion terms are insignificant.

Note that only if both terms $\rho_w c_{pw} s_w$ and $$\frac{1-\phi}{\phi}\rho_R c_{pR}$$

in Eq. 7 are insignificant, will the two fronts travel at the same speed. Otherwise, the injection oil temperature front will necessarily lag behind the injection oil compositional front. Using nominal values of densities and heat capacities for rock, oil, and brine ($\rho_o$=53 lbm/ft$^3$, $\rho_w$=69, $\rho_R$=125, $c_o$=0.55 BTU/° F/lbm, $c_w$=0.8 $c_R$=0.3)[3,13], and $\phi$=0.10, $S_o$=0.85, $$\frac{v}{v_T} = \frac{1}{\beta S_o} \approx 15. \tag{10}$$

The interstitial velocities and transition zone widths are critical in that the oil phase viscosity profile is derived directly from them. Assuming the temperature front lags behind the injection oil front, the viscosity profile is comprised of two transition zones. The trailing viscosity transition zone, that which is closest to the well, corresponds to the temperature front, and varies from $\mu_o(T=T_i)$ to $\mu_o(T=T_r)$. The leading transition zone corresponds to the injection oil composition front, and varies from $\mu_o(\omega_i=1)$ to $\mu_o(\omega_r=1)$. The transition zones are not necessarily separate, and may overlap.

It can be shown that the relative widths of the two transition zones may be quite different under practical conditions. The two diffusion terms in Eqs. 5 and 6 are $$\frac{1}{r}\frac{\partial}{\partial r}\left(rD\frac{\partial \omega_j}{\partial r}\right),$$

corresponding to the composition transition zone, and $$\frac{\beta}{r\rho_o c_{po}}\frac{\partial}{\partial r}\left(rK\frac{\partial T}{\partial r}\right),$$

for the temperature transition zone. The relative importance of these terms may therefore be examined with the ratio $$\frac{K\beta}{\rho_o c_{po} D},$$

which estimates the relative width of the thermal transition zone to that of the composition transition zone.

The coefficient D is comprised of two components, one corresponding to molecular diffusion, and the other to mechanical dispersion. The rate of molecular diffusion is proportional to the gradient of oil composition within the transition zone. The rate of mechanical dispersion is proportional to composition gradient, as well as the oil phase velocity. Except in cases of extremely low oil phase velocity, the diffusion component is relatively small. The diffusion component may be ignored under practical injection test conditions, for injection rates as low as a few barrels per day, as the transition zone velocity is at a maximum due to its proximity to the well. D will therefore be defined as comprised only of the mechanical dispersion component.

The mechanical dispersion term is commonly expressed as, $$D=\alpha v \tag{11}$$

The mechanical dispersion coefficient, $\alpha$, is dependent on those elements in the reservoir, such as pore geometry and tortuousity, that control mechanical mixing of the oil components. Importantly, it is also scale dependent, such that the coefficient grows as the transition zone moves away from the wellbore. The dispersion coefficient will be discussed further below.

The ratio $$\frac{K\beta}{\rho_o c_{po} D}$$

may then be evaluated as, $$\frac{K\beta}{\rho_o c_{po} D} = \frac{K\beta}{\rho_o c_{po} \alpha v} = \frac{2\pi r h \varphi S_o K\beta}{q B_i \rho_o c_{po} \alpha}. \tag{12}$$

The effect of the transition zone on test data analysis is predominant until the zone no longer intersects the well. This occurs when the center of the transition zone is at a radius $\bar{r}\approx 6\alpha$. Substituting for r, the ratio in Eq. 12 may then be estimated, using nominal values of oil, water, and rock densities, specific heat, and heat conductivity (K=1.5 BTU/hr/ft/° F.), and $\phi=0.10$, $S_o=0.85$, h=25 ft, $$\frac{K\beta}{\rho_o c_{po} D} \approx \frac{8}{q B_i}. \tag{13}$$

where q is in surface B/D. It is therefore estimated that only for very low rates of injection will the viscosity transition zone resulting from thermal diffusion be as extensive as that from mechanical dispersion.

It is assumed that practical injection rates will yield a sharp temperature front, relative to the width of the transition zone of the composition front. This assumption will be discussed further below.

Well pressure data is not analyzable during the period a viscosity transition zone intersects the well, as will be demonstrated in the following section. A sharp temperature front minimizes the duration that the thermal transition zone intersects the well, and therefore minimizes the effect on the well pressure response.

Figure 3:
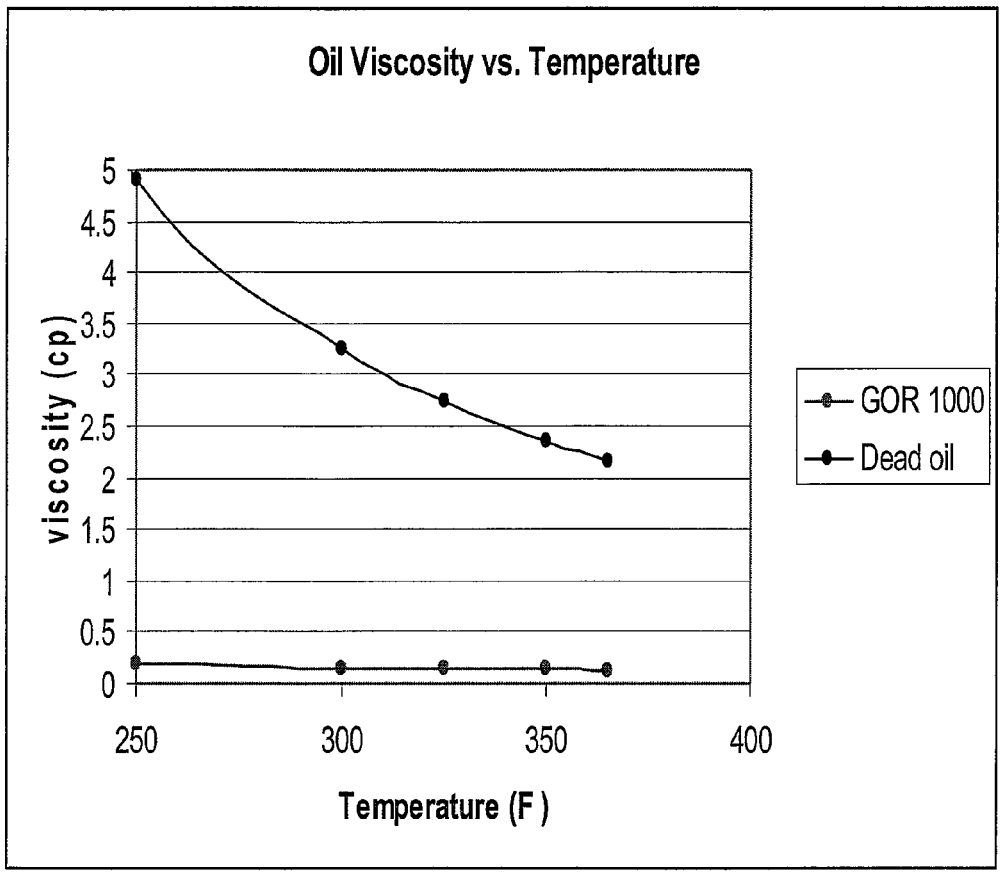
FIG. 3 illustrates the viscosity-temperature behavior for saturated and dead oil in accordance with some embodiments of the present invention.

The viscosity drop at the temperature front depends on reservoir oil properties and injection rate, and can be estimated using the following two figures. FIG. 3 shows the temperature dependence of viscosity computed from correlation for two reservoir oils, one with a solution gas/oil ratio (GOR) of 1000, and the other, a dead oil. It is assumed that the viscosity of the injection liquid will be modified so as to exceed the reservoir oil viscosity at reservoir temperature.

Figure 4:
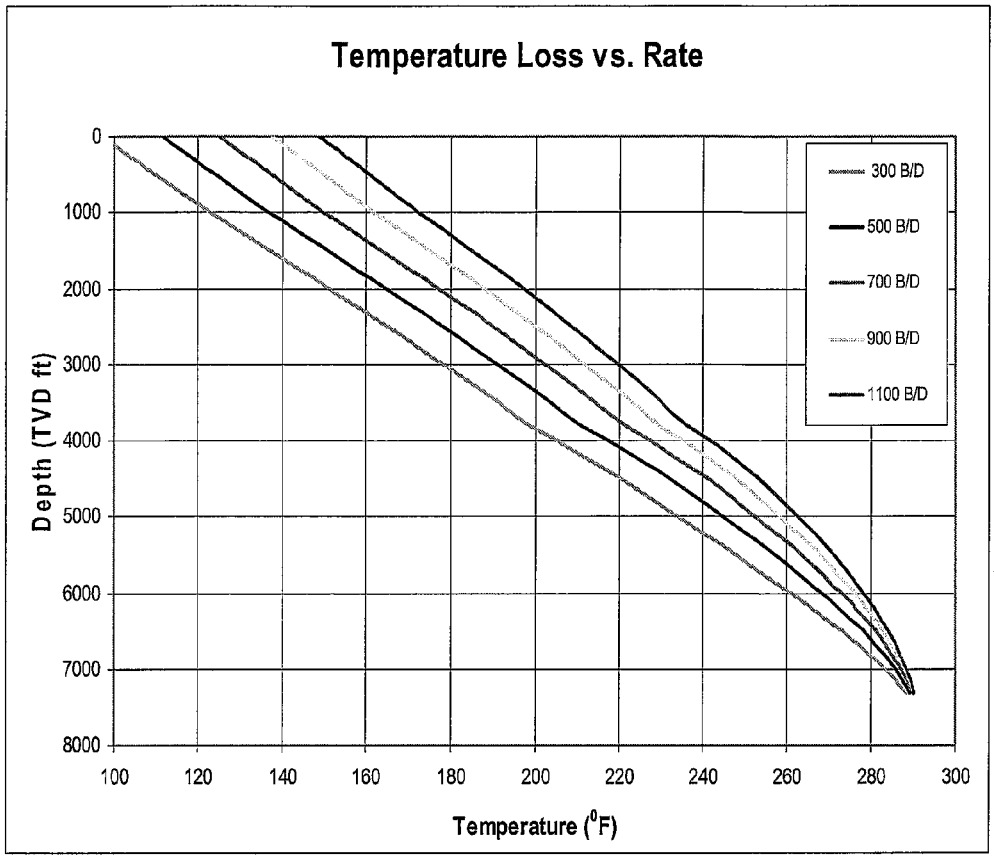
FIG. 4 illustrates wellbore temperature loss during oil production in accordance with some embodiments of the present invention.

FIG. 4 illustrates the rate dependence of oil temperature drop in 3½ in. tubing. Although the curves are for the production case, the temperature differences at the terminal point (in this case the surface, or in the case of injection, the sand face) due to rate, are equivalent to those for injection.

Note the curve corresponding to 300 B/D represents a nearly static case, and that a 50° F. difference is induced by a rate of 1100 B/D. Injection liquid, therefore, is estimated to be 50° F. cooler than reservoir temperature at reservoir depth, when the injection rate is 1100 B/D. The temperature difference will be less for lower rates. The temperature of the injection liquid will be equivalent to that of the reservoir, at 300 B/D injection rate. FIG. 3 indicates that for the 1000 GOR reservoir oil, this cooler temperature does not have a significant effect on viscosity, as the viscosity curves are relatively flat at higher temperatures. The dead oil is more sensitive in the higher range however, with a 50% increase in viscosity over the 50° F. decrease.

The viscosity drop at the temperature front will therefore be significant only for high viscosity oil. However, the jump will be located within the composition transition zone, and its effect on analyzable well pressure data will be insignificant.

Analytical and numerical solutions to Eq. 5 are presented, with D described by Eq. 11. These are presented, in part, in FIG. 5 and FIG. 6. Here, $t_D$ and $r_D$ are defined, $$t_D = \frac{q B_i t}{2\pi h \phi S_o \alpha^2},\ r_D = \frac{r}{\alpha}, \tag{14}$$

and C is concentration, $C=\phi S_o \rho_o \omega_i$.

These solutions are based on $r_w=0$. They were incorporated into the present invention with a linear shift, $\Delta r_D=r_w/\alpha$.

The appropriate boundary condition, used to generate these solutions, is, $$\rho_o u_o \omega_i - \phi S_o \rho_o D \frac{\partial \omega_i}{\partial r} = \frac{q\rho_o}{2\pi r h},\ r = r_w. \tag{15}$$

This results in solutions in which C, or $\omega_i$, are not constant at $r_w$, until some finite time, after which $\omega_i=1$. So, the transition zone is present at the well from the start of injection, and eventually clears the well after a time corresponding to $t_D\approx 16$ (see FIGS. 5 and 6).

The radius, $\bar{r}$, of the center of the transition zone, at $t_D$ is, $$\bar{r} = \sqrt{\frac{q B_i t}{\pi h \phi S_o} - r_w^2} = \alpha\sqrt{2 t_D}. \tag{16}$$

For $t_D=16$, $\bar{r}\approx 6\alpha$, a result used above.

Figure 5:
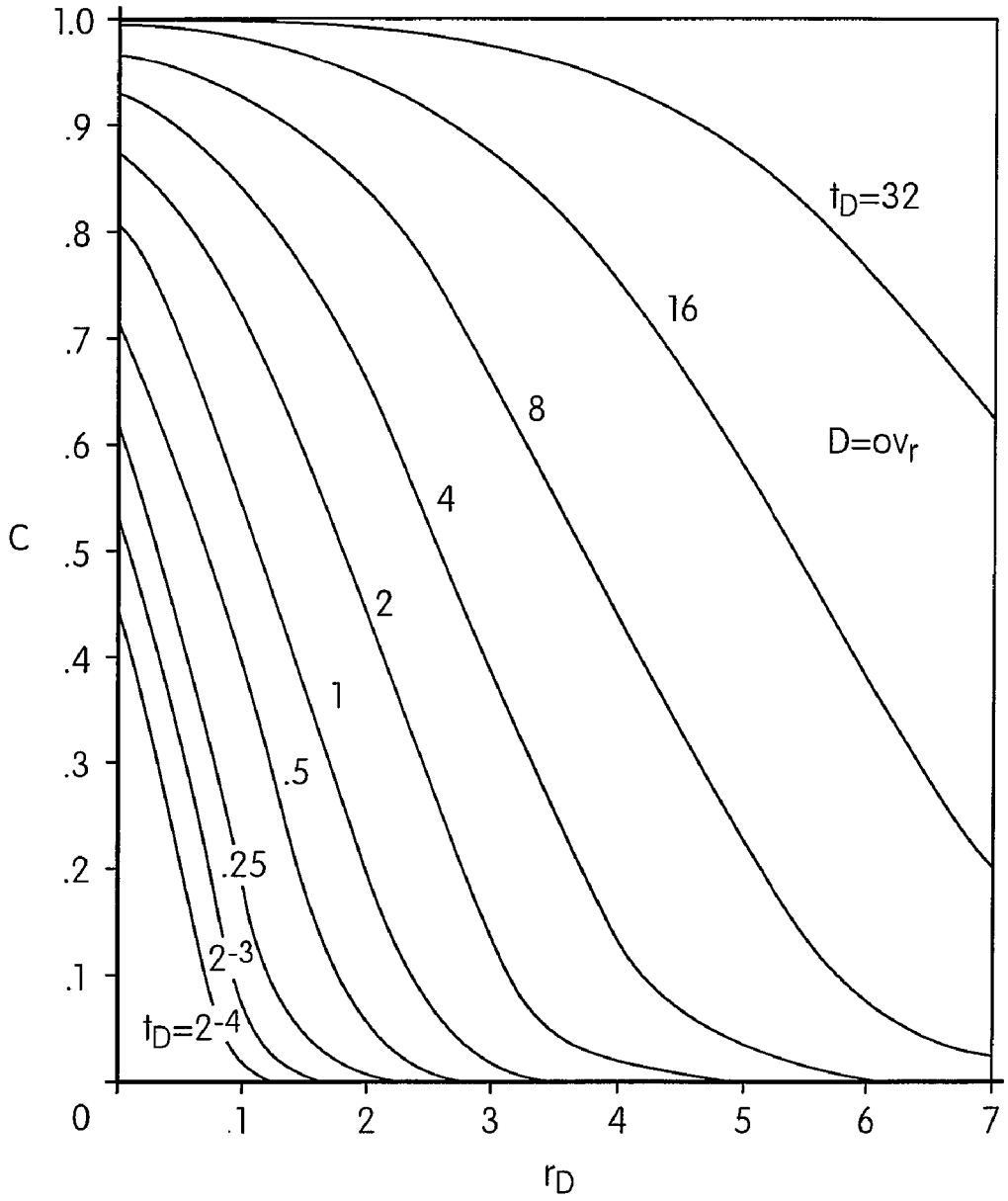
FIG. 5 illustrates concentration profile solution for the convention diffusion equation, $t_D \leqq 32$ in accordance with some embodiments of the present invention.
Figure 6:
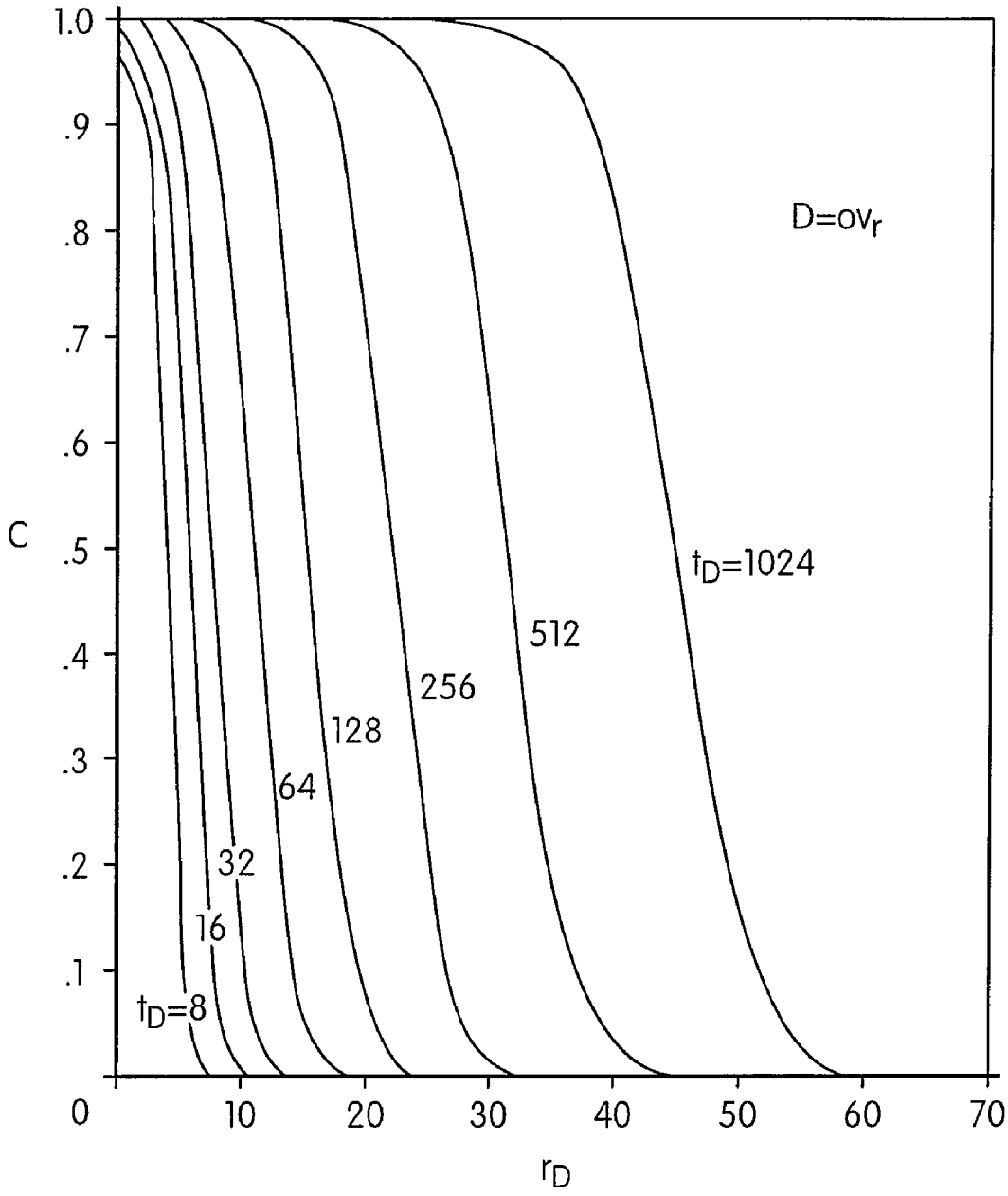
FIG. 6 illustrates concentration profile solution for the convention diffusion equation, $t_D \geqq 8$ in accordance with some embodiments of the present invention in accordance with some embodiments of the present invention.

The duration during which the composition transition zone intersects the well is insignificant for large, field scale problems such as waterflooding, and for such the boundary condition $\omega_i=1$ at $r=r_w$ is appropriate. However, for injection testing, for which early time behavior is important, the solutions presented in FIG. 5 and FIG. 6 are appropriate, and were used to generate the viscosity profiles incorporated into the well pressure model.

The assumption made above of a sharp thermal front is verified by numerical solutions to Eq. 6, for the application of cold water injection into geothermal reservoirs. Only a thermal transition zone exists for this case, and the thermal transition thickness, $\Delta r_T$, is estimated to be, $$\Delta r_T \approx 0.055 r_w \sqrt{t} \tag{17}$$

where t is in seconds. This estimate is an upper bound for the oil reservoir case as the product $K\beta$ is generally smaller for an oil saturated system than for a water saturated system. Substituting for t from Eq. 14, with $t_D$=16, and for the width of the composition transition zone, $\Delta r_c=2\bar{r}$ as it clears the well, the ratio of the widths is, $$\frac{\Delta r_C}{\Delta r_T} \approx \frac{1}{5.5 r_w}\sqrt{\frac{qB_i}{h\phi S_o}}, \tag{18}$$

where q is in surface B/D. This ratio is large except for low injection rates.

Substituting the reservoir parameters used in Eq. 10, where $v/v_T \approx 15$, and q=500 B/D, $B_i$=1, and $r_w$=0.25 ft, yields $\Delta r_C/\Delta r_T \approx 11$. Thus, although the temperature front is slower than the composition front, its transition is much smaller. Although it is possible the temperature transition zone remains intersected with the well after the composition transition zone has cleared the well, it is assumed in this study that this period is short, and that the effect of the temperature front on well pressure response is not prolonged.

A constant rate solution to Eq. 4, at the well, which assumes incompressible flow in the transition zone and in the zone, comprised of 100% injection oil, between the transition zone and the well, is, $$p_{wD} = \frac{1}{2}\left(\ln\frac{t'_D}{r'_{Dmax}} + 0.80907\right) + \frac{\mu_t}{\mu_r}\ln\frac{r'_{Dmax}}{r'_{Dmin}} + \frac{\mu_i}{\mu_r}\ln r'_{Dmin} + S \tag{19}$$

This is the well pressure model developed in the present invention. Wellbore storage effect is not included in the model. Here, $t'_D$ is the conventional dimensionless time, $r'_{Dmin}$ and $r'_{Dmax}$ are the boundaries of the transition zone expressed as conventional dimensionless radii, $\mu_i$ is the viscosity of the injection oil at the well injection temperature, and $\mu_r$ is the viscosity of the reservoir oil at reservoir temperature. Note that during the time when the transition zone intersects the well, $r'_{Dmin}$=1, and the $$\frac{\mu_i}{\mu_r}\ln r'_{Dmin}$$

term is zero.

$r_{Dmin}(t_D)$ and $r_{Dmax}(t_D)$ are obtained from a solution of Eq. 5. $t'_D$ is obtained from $t_D$, given α, $r_w$, q, and reservoir properties.

The viscosity of the transition zone may be represented by a single value $\mu_t$, if the viscosity function is linear with radius in the transition zone. A linear viscosity function, used in this model, is, $$\mu(r'_D) = \mu_{min} + \frac{\mu_r - \mu_{min}}{(r'_{Dmax} - r'_{Dmin})}(r'_D - r'_{Dmin}). \tag{20}$$

$$\mu_{min} = C\mu_i + (1 - C)\mu_r. \tag{21}$$

$C(t_D)$ is the concentration at dimensionless time as defined in Eq. 14.

Interpretation of the injection test may be performed from a rearrangement of Eq. 19, with substitutions involving the radius of the center of the transition zone, $\bar{r}(t'_D)$, $$r'_{Dmin} = \chi_{min}(t'_D)\frac{\bar{r}(t'_D)}{r_w}. \tag{22}$$

$$r'_{Dmax} = \chi_{max}(t'_D)\frac{\bar{r}(t'_D)}{r_w}$$

$\chi_{min}$ and $\chi_{max}$ are scalar functions of $t'_D$. Note that $0 \leqq \chi_{min}(t_D) < 1$ and $\chi_{max}(t_D) > 1$.

When $\bar{r}^2 >> r_w^2$, the substitutions result in the following, $$p_{wD} = \frac{1}{2}\left(\frac{\mu_i}{\mu_r}\ln t'_D + 0.80907\right) + \frac{1}{2}\left(\frac{\mu_i}{\mu_r} - 1\right)\ln A + B + s \tag{23}$$

$$A = \frac{qB_i\mu_r c_t}{\pi k h S_0}$$

$$B = \frac{1}{2}\left(\frac{\mu_i}{\mu_r} - \frac{\mu_t}{\mu_r}\right)\ln\chi_{min} + \frac{1}{2}\left(\frac{\mu_t}{\mu_r} - 1\right)\ln\chi_{max}.$$

Note that this $p_{wD}$ model is similar to the log approximation solution to the diffusivity equation, except here the semi-log slope is multiplied by $\mu_i/\mu_r$, and the semi-log intercept includes two additional terms. Note also the derivative-time product is, $$\frac{\partial p_{wD}}{\partial t'_D} t'_D = \frac{1}{2}\frac{\mu_i}{\mu_r}. \tag{24}$$

$$\frac{\partial p_w}{\partial t} t = \frac{qB_i\mu_i}{4\pi k h}. \tag{25}$$

So, the pressure derivative plot is diagnostic, that is, constant at $$\frac{1}{2}\frac{\mu_i}{\mu_r},$$

for the time when Eq. 23 is valid. During this time, analysis will yield the reservoir permeability k, assuming $\mu_i$ is known, as indicated in Eq. 25.

Use of pressure transient analysis applications to perform this analysis is straightforward, using the following, $$k = \frac{\mu_i}{\mu_r}k'. \tag{26}$$

where k' is the estimated reservoir permeability, from the time region in which Eq. 23 is valid.

Further, this estimate of k allows the computation of A, given estimates of the remaining parameters of that term. Typical values of total compressibility, $c_t$, for a single phase oil system insures that A is a small number and that ln A is relatively large in magnitude. The term B however, is generally much smaller in magnitude, and may be ignored. Note first that the terms in B necessarily have opposing signs. Secondly, the magnitudes of the coefficients of the log terms of B are both necessarily smaller than the coefficient of ln A. Finally, it can be shown from FIGS. 5 and 6 that $\chi_{min}$>0.13 and $\chi_{max}$<1.9 for $t_D$>32, when the transition zone is still near the well. So, the magnitudes of the log terms in B do not exceed 2.

When B is ignored, well skin s may be estimated from the semi-log intercept. This can be done using the following, $$s = s' - \frac{1}{2}\left(\frac{\mu_i}{\mu_r} - 1\right)\ln A, \tag{27}$$

Where s' is the estimated skin from a pressure transient analysis.

The transition zone viscosity function is assumed to be piecewise linear in an some aspects of the present invention, with a shallow sloped function at $r'_{Dmin}$ and a steeper sloped function at $r'_{Dmax}$, to approximate more closely the behavior of C in FIGS. 5 and 6. This viscosity function does not require any modification to Eqs. 26 and 27, as it only modifies the term B. The function serves only to smooth the $P_{wD}$ response as the transition zone clears the well.

Figure 7:
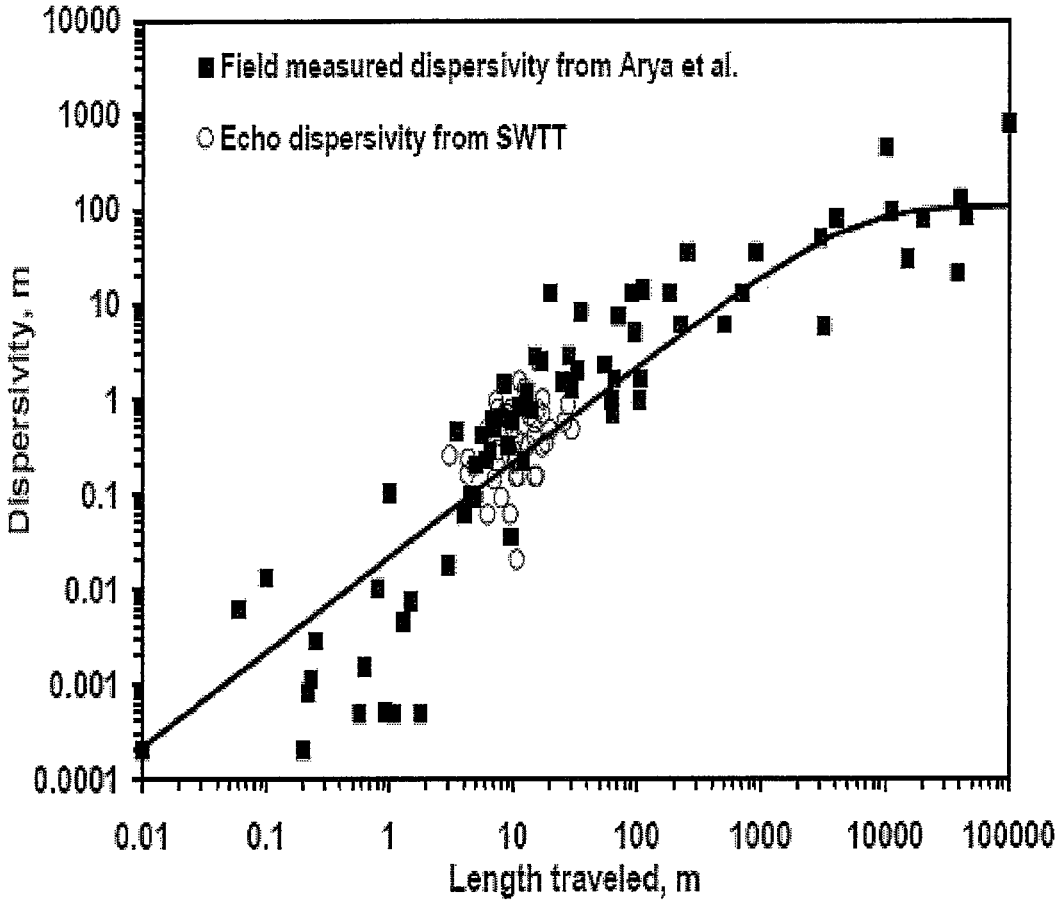
FIG. 7 illustrates scale dependence of the dispersion coefficient in accordance with some embodiments of the present invention.

The dispersion coefficient $\alpha$ is scale dependent, such that it is proportional to the distance over which the composition front travels. FIG. 7 shows measured $\alpha$ data at various scales. The echo dispersivity (dispersion), single well tracer test (SWTT) data is most relevant, as these data are computed from tests in which a tracer is injected, and then produced, from a single well. The distance of travel in this case is twice the maximum radial extent of the tracer front. As illustrated in FIG. 7, laboratory and field data correlates well.

The range of $\alpha$ applicable to injection testing conditions should generally correspond to the SWTT data and smaller, as the transition zone most affects the well pressure response as it intersects and is near the well. The data at smaller scales than SWTT in FIG. 7 correspond to laboratory data.

The applicable range of the dispersivity data in FIG. 7, for injection testing, should be $0.003<\alpha<0.3$ m or $0.01<\alpha<1$ ft. The maximum value of this range corresponds to a front travel distance of 15 ft, approximately that for the conditions q=100 BID, $\phi=0.10$, $S_o=0.85$, h=10 ft, t=24 hr, which should represent an extreme case, as the interval is relatively thin, the injection rate relatively high, and the effect of the transition zone is generally null much sooner than 24 hr.

Figure 8:
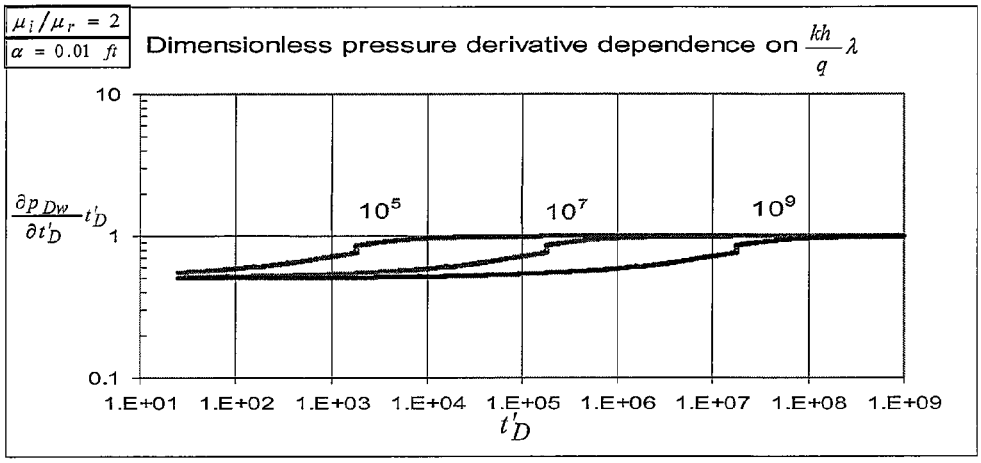
FIG. 8 illustrates the dimensionless derivative behavior for various a in accordance with some embodiments of the present invention.
Figure 8:
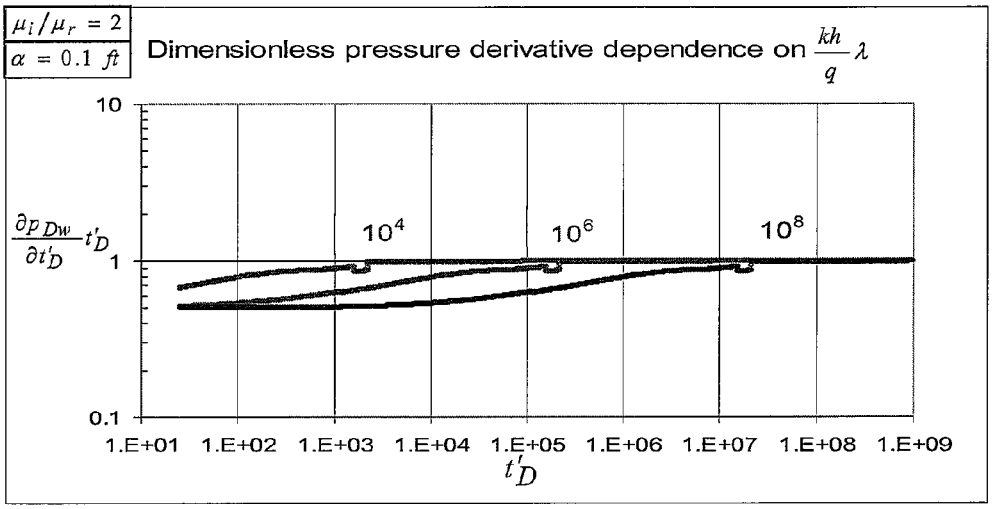
Figure 8:
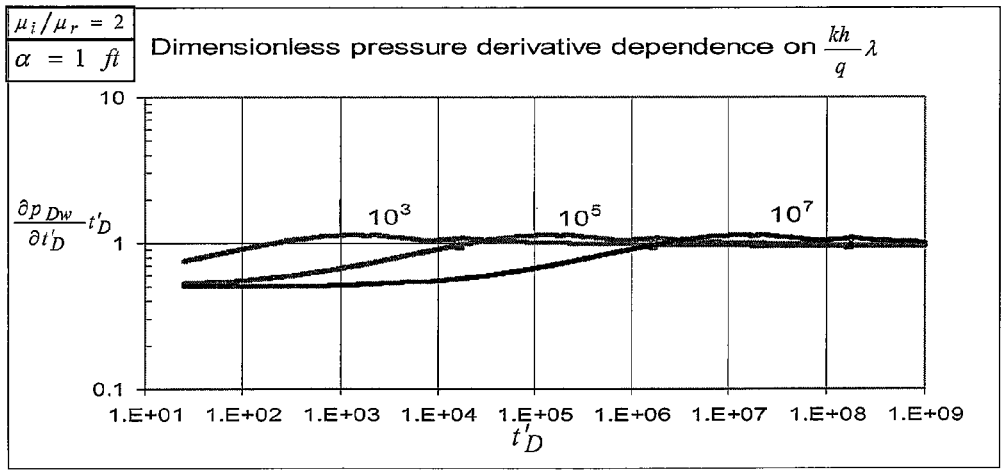

The dimensionless pressure derivative estimate from Eq. 19 for various $\alpha$ is presented in FIG. 8, for $\mu_i/\mu_r=2$. Note the effect of the composition transition zone is to gradually shift the derivative from an initial plateau of 0.5, to a second plateau at $$0.5\frac{\mu_i}{\mu_r},$$

in this case, 1.0. The duration of the transition time from the first plateau to the second, increases with increasing $\alpha$.

The initial plateau is derived from the well response associated with the reservoir oil viscosity. Practically, the initial plateau will not be detectable as it exists early enough to be masked by wellbore storage and skin effects. The second plateau, derived from the well response associated with injection oil viscosity, will be sustained until reservoir boundary effects become significant.

Dimensionless well pressure response is also permeability-thickness and rate dependent. This is seen in Eq. 19, as $r'_{Dmin}$ and $r'_{Dmax}$ are functions of $r_D$, which is a function of $t_D$. The definition of $t'_D$, and Eq. 14, yield $$r'_D = \frac{\alpha r_D(t_D)}{r_w} \tag{28}$$

$$t'_D = t_D\frac{kh}{a}\lambda\alpha^2$$

$$\lambda = \frac{2\pi S_o}{B_i\mu_r c_i r_w^2}.$$

The dimensionless pressure curves will be unique for the ratio $$\frac{kh}{q}\lambda,$$

for a given $\alpha$.

Note from Eq. 14 that the effect of the transition zone is dependent only on the ratio q/h, as the width and velocity of the transition zone is dependent on $t_D$ ($r_D$), shown in FIGS. 5 and 6. The transition zone behavior, and therefore its effect on well response, is not dependent on k.

Figure 9:
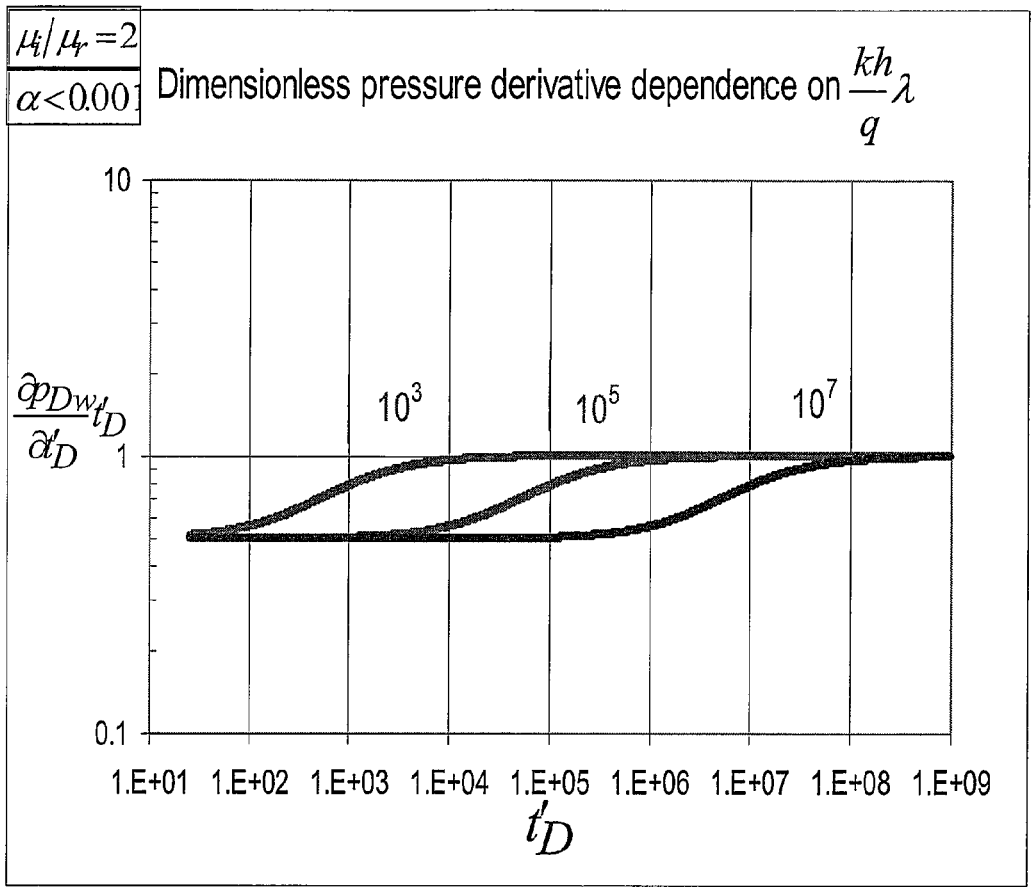
FIG. 9 illustrates the dimensionless derivative behavior for piston-like displacement in accordance with some embodiments of the present invention.

Piston-like displacement is represented in FIG. 9, in which $\alpha$ is a very small number. The derivative results do not change significantly with $\alpha$ when $\alpha<0.001$.

The effect of $\mu_i/\mu_r$ on the curve shape is to change the vertical step of the transition, although the width of the transition is not affected. This is seen in FIG. 10, for which $\mu_i/\mu_r=4$.

Figure 10:
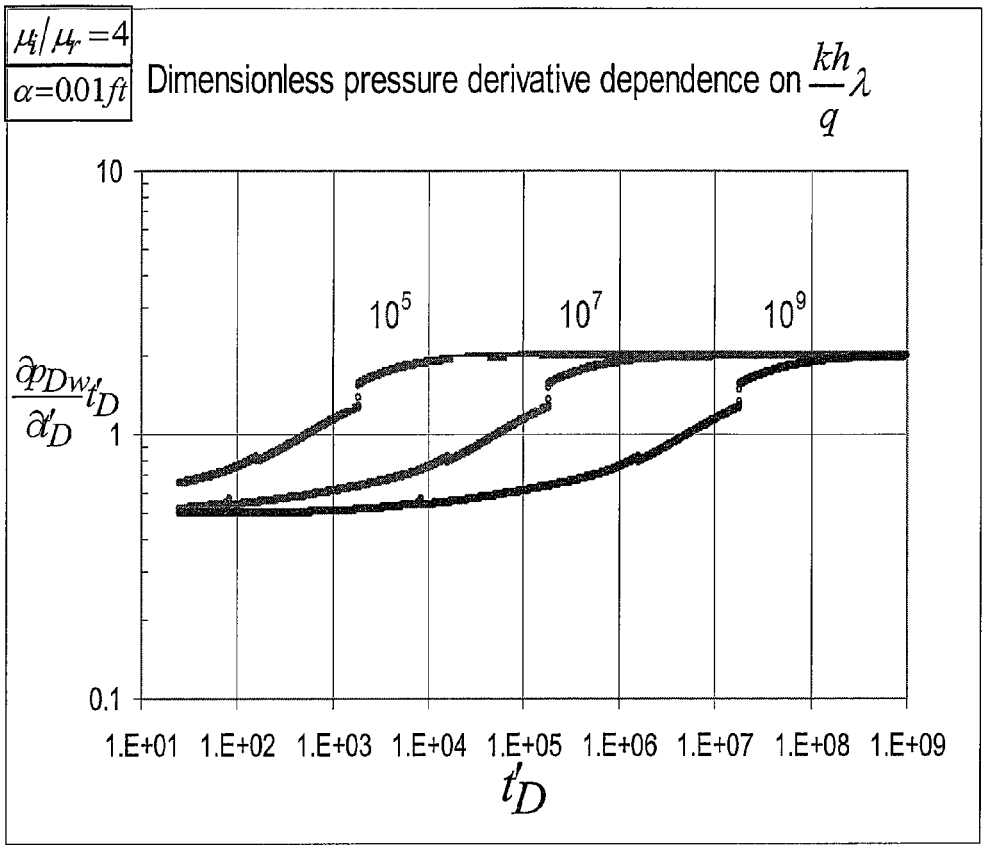
FIG. 10 illustrates the dimensionless derivative behavior for $\mu_i/\mu_r=4$ in accordance with some embodiments of the present invention.

The curves in FIGS. 8-10 were generated numerically from Eq. 19. The spurious sections of the curves are caused by the assumption of piecewise linearity of the viscosity function within the composition transition zone. The viscosity function is therefore not smooth at the transition boundaries. The spurious sections begin and end when the transition clears the well. A smoother viscosity transition at the inner boundary of the transition zone would eliminate the spikes. Note that the onset of the second plateau coincides with the spikes, that is, the effect of the composition transition zone on well pressure response is small after the zone clears the well.

Figure 11:
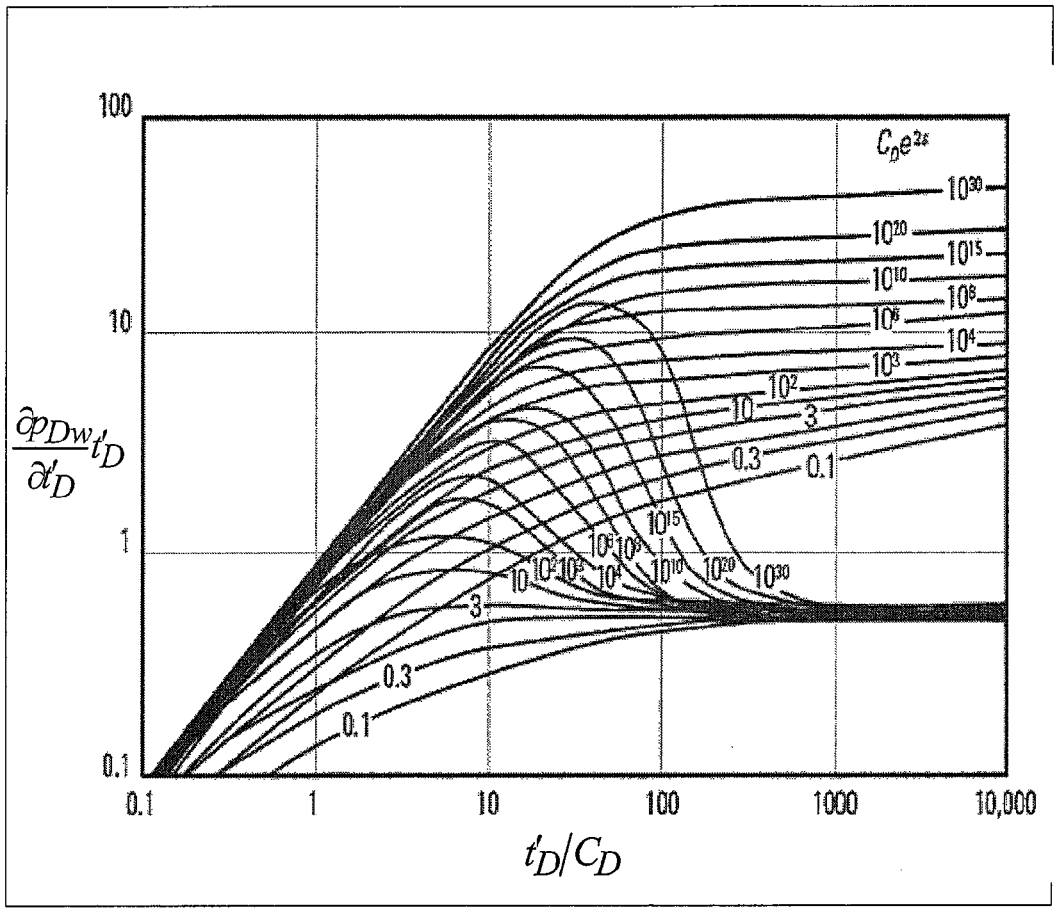
FIG. 11 illustrates the wellbore storage and skin effect in accordance with some embodiments of the present invention.

The proximity of the transition period and second plateau to wellbore storage and skin effects may be seen from FIG. 11, compared to FIG. 8. FIG. 8 indicates that, in general, the second plateau is established after $t'_D=1\times10^5$. The dimensionless wellbore storage coefficient, $C_D$, corresponding to an injection TST in 10000 ft of 3½ in. tubing, the practical maximum length of tubing expected for the test program, is $C_D\approx500$, for example. FIG. 11 indicates the storage effect ends at $t'_D/C_D\approx1000$ for most values of skin, and thus at $t'_D\approx5\times10^5$ for $C_D=500$. So, the wellbore storage effect is estimated to end prior to attainment of the second plateau, in general, for the test program.

Storage and skin effects should therefore be insignificant when the second plateau is established. This comparison also suggests the initial plateau period and transition period may be masked by wellbore storage effect, although this is of no consequence since the second plateau yields interpretable data.

Injection test rates for anticipated well and reservoir conditions may be estimated under the criteria of minimizing injection period duration, while retaining useful pressure transient data.

Reservoir permeability and oil properties in the sandstone reservoirs are currently uncertain, so analogous basin equivalent values may apply. Permeability is therefore estimated to vary from 1 md to 100 md. Analogous basin reservoir oil tends to be paraffinic, and the viscosity at reservoir conditions may exceed 1 cp.

Reservoir geometry will affect the transient data, and generally consist of two parallel faults. The wells will be drilled within 100 m. of the trapping fault for the system. The other fault is generally a greater distance, approximately by a factor of 10, or greater, from the well. These two faults are resolved with seismic interpretation. As the faults are generally short, and parallel, a rectangular reservoir boundary cannot be formed, so the system is otherwise open. However, lack of sand continuity will likely limit the reservoir extent in directions both parallel and orthogonal to the faults. Thus, a stratigraphic boundary will more likely be detected during the test than will the far fault. Sand continuity cannot be adequately resolved with seismic data to predict stratigraphic boundary effects.

Test data will likely exhibit the effect of the trapping fault, but not the second fault. Only extremely limited sands, on the order of the distance to the trapping fault, will affect the test data.

Wellbore storage effects are considered at the maximum anticipated test depths, which will correspond to not more than 10000 ft of 3-½ in. tubing. The liquid compressibility of SARALINE 185V is assumed to apply, resulting in a dimensionless storage coefficient $C_D \approx 500$.

Well skin is estimated to be a maximum +20, which has been measured on some analogous basin wells.

Figure 12:
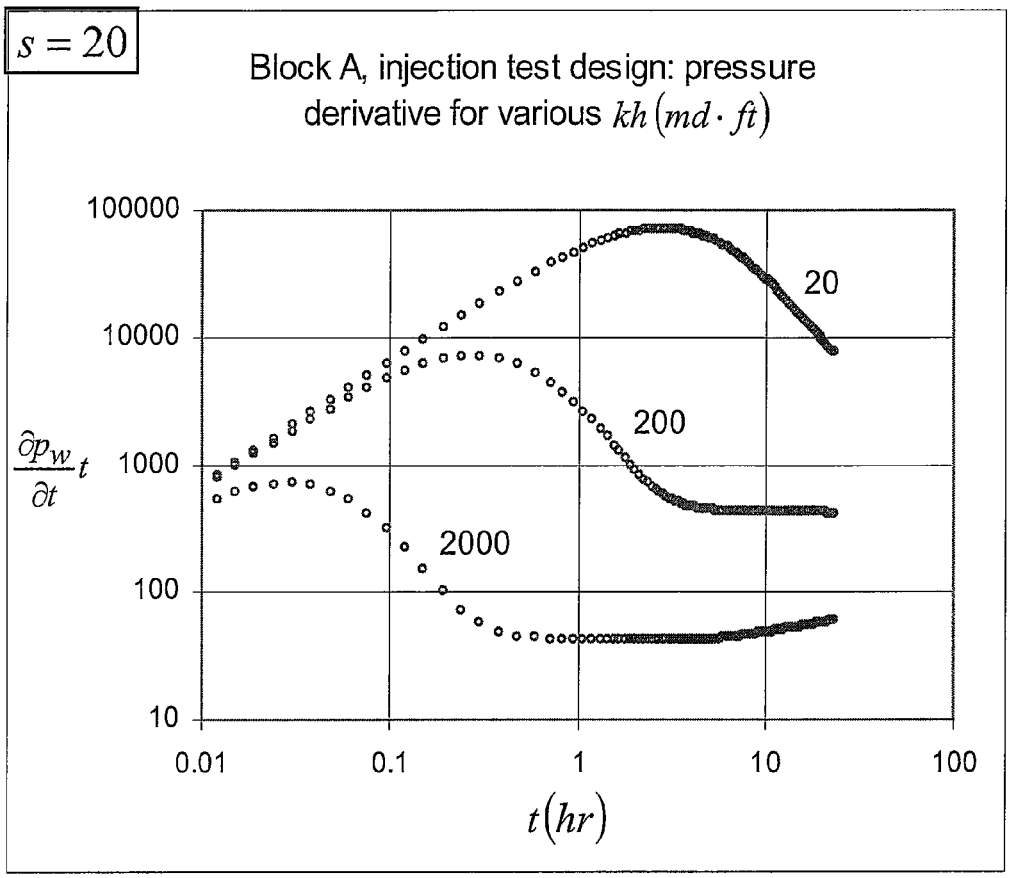
FIG. 12 illustrates the pressure transient behavior for various kh and s=20 in accordance with some embodiments of the present invention.
Figure 13:
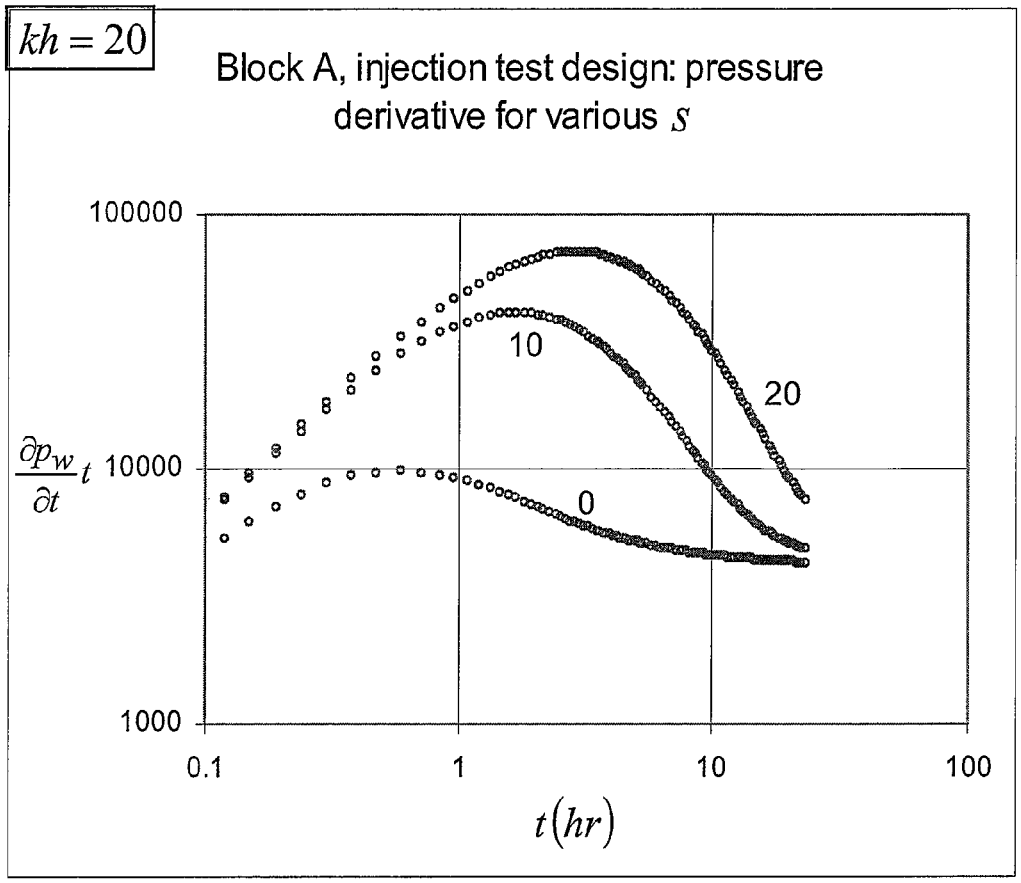
FIG. 13 illustrates the pressure transient behavior for various s and kh=20 md·f in accordance with some embodiments of the present invention.

FIG. 12 and FIG. 13 show the injection pressure and derivative response for a paraffinic oil at various values of kh and skin effect, s, from the pressure transient analysis application Saphir. FIG. 12 shows the response for 20<kh<2000 md·ft, given s=20. FIG. 11 shows the effect of 0<s<20, for kh=20 md·ft. The test duration is 24 hours.

The responses in FIGS. 12 and 13 do not include the effect of oil composition gradient.

Note that for kh=2000 md·ft, the effect of the trapping fault is realized, in approximately 5 hours. A subsequent constant derivative period, expected to follow this effect, does not form before 24 hrs. Thus, for well tests constrained to durations below 20 hours, the constant derivative period preceding the fault effect must be analyzable. Note that this preceding period is not formed for kh=20 md·ft. However, FIG. 13 indicates that for the smaller skin value s=0, the constant derivative period is barely reached in 24 hours. The kh=20 md·ft case is therefore essentially not interpretable from short term test data.

Figure 14:
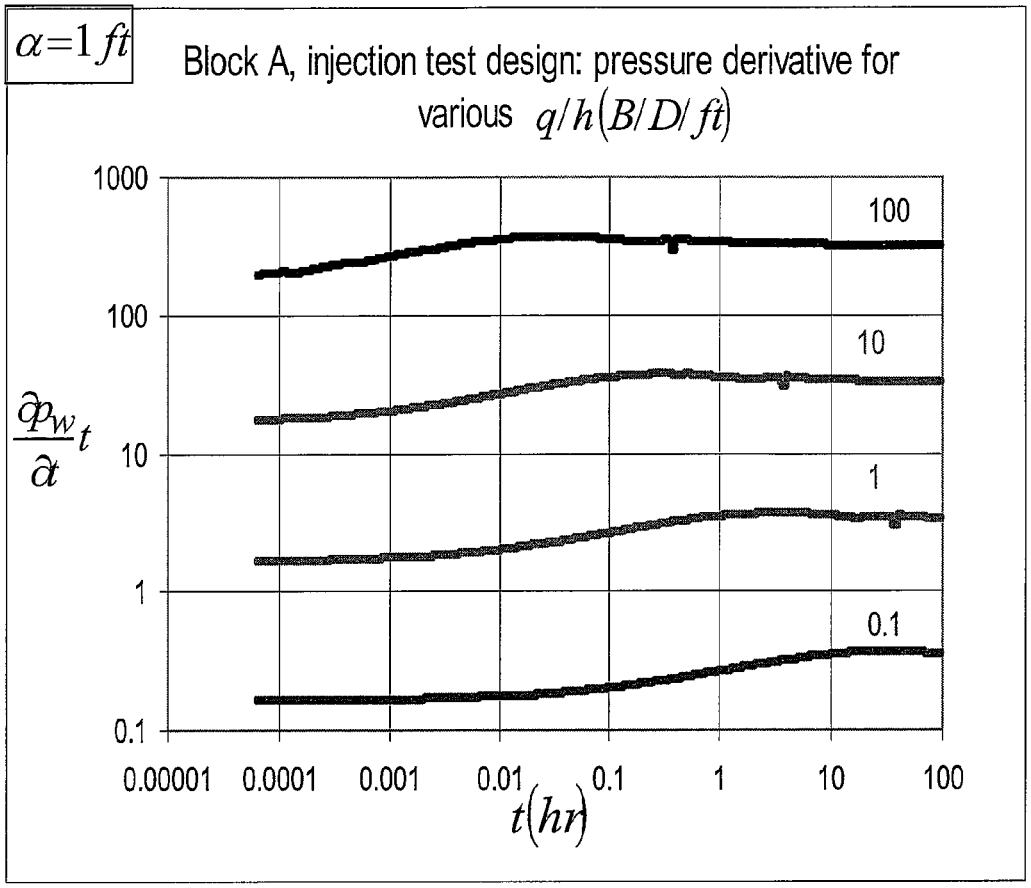
FIG. 14 illustrates the pressure transient behavior for various q/h in accordance with some embodiments of the present invention.

The effect of the oil composition transition zone is included in the transient response presented in FIG. 14, for various q/h and $\alpha$=1, which represents the case with the greatest anticipated effect of the transition zone.

The effect of wellbore storage is not included in FIG. 14. The use of FIGS. 12-14 combined, allow for the investigation of both wellbore storage and oil composition transition.

Note in FIG. 14 that higher injection rates cause the second plateau to be reached sooner than lower injection rates. This is an advantage to injection tests with higher rates, and represents a major difference relative to conventional production rate testing, in which rate does not affect the time at which the derivative becomes constant.

The constant derivative period in FIG. 12 occurs before 1 hour, at the earliest. This period is intact until it is disturbed, in the kh=2000 md·ft case, by the fault effect. Therefore, it is desired that the injection rate be such that the oil composition effect has completely transpired before 1 hour. FIG. 14 indicates the value of q/h should then exceed 10. The rate associated with h=20 ft, for example, should then exceed 200 B/D.

As the curves in FIG. 14 are estimated injection well pressure responses using Eq. 19, the estimates of permeability and skin from Eqs. 26 and 27 may be tested using these pressure data, from the second plateau region. Table 1 in FIG. 15 presents the results of these tests for each curve presented. The time at which the interpretations are made are t≦10 hr. Note that the predictions are acceptable, indicating that the assumption of B being negligible in Eq. 23, is acceptable.

Note also that the case corresponding to a test time of 5 hours and q=200 B/D, which yields a ratio q/h=10, yields acceptable estimates of k and s.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, though reference is made herein to a computer, this may include a general purpose computer, a purpose-built computer, an ASIC including machine executable instructions and programmed to execute the methods, a computer array or network, or other appropriate computing device. As a further example, it is to be understood that the present invention contemplates that, to the extent possible, one or more features of any embodiment can be combined with one or more features of any other embodiment.

APPENDIX

Nomenclature

A Eq. 23

B Eq. 23

$B_i$ FVF of injection oil

C concentration, $C=\phi S_o \rho_o \omega_i$ $c_{po}$ specific heat of the oil phase $c_{pw}$ specific heat of the water phase $c_{pR}$ specific heat of the rock $c_t$ total system compressibility, $$c_t = S_w c_w \frac{\rho_w}{\rho_o} + S_o c_o + \frac{1-\phi}{\phi} c_R \frac{\rho_R}{\rho_o}$$

$c_w$ compressibility of water $c_O$ compressibility of reservoir oil $c_R$ compressibility of rock D coefficient of diffusion h reservoir thickness $H_o$ specific enthalpy of the oil phase k reservoir permeability k' reservoir permeability estimated from conventional pressure transient analysis K heat conduction coefficient of the oil, water, rock system p reservoir pressure $p_{wD}$ dimensionless well pressure, $$p_{wD} = \frac{2\pi kh}{qB_i\mu_r}(p_i - p_w)$$

$p_i$ initial reservoir pressure
$p_w$ well injection pressure
q surface injection rate
r radius
$r_w$ wellbore radius
$\bar{r}$ radius of the center of the composition transition zone
$r_D$ Tang-Peaceman dimensionless radius, Eq. 14
$r'_{Dmin}$ minimum dimensionless radius of the composition transition zone, $$r'_{Dmin} = \frac{r_{min}}{r_w}$$

$r'_{Dmax}$ maximum dimensionless radius of the composition transition zone, $$r'_{Dmax} = \frac{r_{max}}{r_w}$$

$r_{max}$ maximum radius of the composition transition zone
$r_{min}$ minimum radius of the composition transition zone
$\Delta r_T$ thickness of the thermal transition zone, Eq. 17
$\Delta r_C$ thickness of the compositional transition zone
s skin factor
s' skin factor estimated from conventional pressure transient analysis
$S_o$ oil saturation, fraction
$S_w$ water saturation, fraction
t time
$t_D$ Tang-Peaceman dimensionless time, Eq. 14
$t'_D$ dimensionless time, $$t'_D = \frac{kt}{\phi\mu c_t r_w^2}$$

T temperature of the system
$T_i$ temperature of the injection oil at the point of injection
$T_r$ temperature of the reservoir prior to injection
$U_o$ specific internal energy of the oil phase
$U_w$ specific internal energy of the water phase
$U_R$ specific internal energy of the rock
v interstitial velocity of the injection oil component
$v_T$ velocity of the temperature front
$\alpha$ coefficient of mechanical radial dispersion
$\beta$ Eq. 7
$\chi_{min}$ Eq. 22
$\chi_{max}$ Eq. 22
$\phi$ porosity, fraction
$\mu_o$ oil phase viscosity
$\mu_i$ viscosity of injection oil component at $T_i$
$\mu_r$ viscosity of reservoir oil component at $T_r$
$\mu_{min}$ viscosity of oil phase at the minimum radius of the composition transition zone
$\rho_o$ density of the oil phase
$\rho_o$ density of the water phase
$\rho_R$ density of the rock
$\omega_j$ mass fraction of component j in the oil phase
$\omega_{jw}$ mass fraction of component j absorbed into the water phase
$\omega_{jR}$ mass fraction of component j adsorbed onto the rock

What is claimed is:

1. A method of determining reservoir permeability and geometry of a subterranean formation having a reservoir fluid including oil that has not been previously water-flooded, the method comprising:

isolating hydraulically the subterranean formation to be tested;

providing an injection oil at a substantially constant rate to the formation being tested, wherein the injection oil is miscible with the oil at the tested formation;

sealing, at the top, the tested formation from further oil injection;

measuring pressure data in the tested formation including pressure injection data and pressure falloff data; and determining the reservoir permeability and geometry of the tested formation based on an analysis of the measured pressure injection data and the measured pressure falloff data using a well pressure model.

2. The method of claim 1, wherein the providing occurs at a wellhead located above the formation being tested.

3. The method of claim 1, wherein the injection oil has a viscosity greater than the oil.

4. The method of claim 1, further comprising:

obtaining the injection oil from the tested formation prior to providing the injection oil to the tested formation.

5. The method of claim 1, wherein at least one of additives including bentonite and hectorite based organoclays or polar activators including ethanol and triethylene glycol are combined with the injection oil to increase a viscosity of the injection oil.

6. The method of claim 1, wherein the permeability is estimated based on a ratio of an inferred viscosity of the injection oil and a viscosity of the oil.

7. The method of claim 1, wherein the well pressure model is $$p_{wD} = \frac{1}{2}\left(\ln\frac{t'_D}{r'_{Dmax}} + 0.80907\right) + \frac{\mu_i}{\mu_r}\ln\frac{r'_{Dmax}}{r'_{Dmin}} + \frac{\mu_i}{\mu_r}\ln r'_{Dmin} + s,$$

wherein $t'_D$ is a dimensionless time, $r'_{Dmin}$ and $r'_{Dmax}$ are boundaries of a transition zone expressed as dimensionless radii, $\mu_i$ is a viscosity of the injection oil at a well injection temperature, and $\mu_r$ is a viscosity of the reservoir fluid at reservoir temperature.

8. The method of claim 1, further comprising measuring at least one of a bottom hole pressure, a bottom hole temperature, a surface oil injection rate, or a surface tubing pressure.

9. The method of claim 8, wherein a viscosity of the injection oil is inferred from the measured bottom hole temperature.

10. A system for determining a reservoir permeability and geometry of a subterranean formation having a reservoir fluid including oil that has not been previously water-flooded, the system comprising:

an injector constructed and arranged to inject an injection oil at a substantially constant rate from a wellhead into the formation being tested, wherein the injection oil is miscible with the oil at the tested formation;

one or more sensors constructed and arranged to measure data in the tested layer including pressure injection data and pressure falloff data; and a machine readable medium having machine executable instructions constructed and arranged to determine the reservoir permeability and geometry of the tested formation based on an analysis of the measured pressure injection data and the measured pressure falloff data using a well pressure model stored in a memory coupled to a processor.

11. The system of claim 10, wherein the injection oil has a viscosity greater than the oil.

12. The system of claim 10, further comprising:

an extractor configured to extract the injection oil from the tested formation prior to the injector injecting the injection oil into the tested formation.

13. The system of claim 10, wherein at least one of additives including bentonite and hectorite based organoclays or polar activators including ethanol and triethylene glycol are combined with the injection oil to increase a viscosity of the injection oil.

14. The system of claim 10, wherein the permeability is estimated based on a ratio of an inferred viscosity of the injection oil and a viscosity of the oil.

15. The system of claim 10, wherein the well pressure model is $$p_{wD} = \frac{1}{2}\left(\ln\frac{t'_D}{r'_{Dmax}} + 0.80907\right) + \frac{\mu_t}{\mu_r}\ln\frac{r'_{Dmax}}{r'_{Dmin}} + \frac{\mu_i}{\mu_r}\ln r'_{Dmin} + s,$$

wherein $t'_D$ is a dimensionless time, $r'_{Dmin}$ and $r'_{Dmax}$ are boundaries of a transition zone expressed as dimensionless radii, $\mu_i$ is a viscosity of the injection oil at a well injection temperature, and $\mu_r$ is a viscosity of the reservoir fluid at reservoir temperature.

16. The system of claim 10, wherein the one or more sensors are further configured to measure at least one of a bottom hole pressure, a bottom hole temperature, a surface oil injection rate, or a surface tubing.

17. The system of claim 16, wherein a viscosity of the injection oil is inferred from the measured bottom hole temperature.

* * * * *